US007978163B2

(12) United States Patent
Kim

(10) Patent No.: US 7,978,163 B2
(45) Date of Patent: Jul. 12, 2011

(54) APPARATUS AND METHOD FOR DRIVING A LIQUID CRYSTAL DISPLAY

(75) Inventor: Boo Young Kim, Gyeongsangbuk-do (KR)

(73) Assignee: LG Display Co., Ltd., Seoul (KR)

( * ) Notice: Subject to any disclaimer, the term of this patent is extended or adjusted under 35 U.S.C. 154(b) by 761 days.

(21) Appl. No.: 11/640,096

(22) Filed: Dec. 14, 2006

(65) Prior Publication Data

US 2007/0164952 A1 Jul. 19, 2007

(30) Foreign Application Priority Data

Dec. 27, 2005 (KR) ..... 10-2005-0130781

(51) Int. Cl.
*G09G 3/36* (2006.01)

(52) U.S. Cl. ..... 345/87; 345/96

(58) Field of Classification Search ..... 345/87, 345/96

See application file for complete search history.

(56) References Cited

U.S. PATENT DOCUMENTS

2002/0018035 A1* 2/2002 Song et al. ..... 345/87
2007/0001963 A1* 1/2007 Koma ..... 345/96

FOREIGN PATENT DOCUMENTS

JP 05-107557 4/1993
JP 05107557 * 4/1993
JP 07-120720 5/1995
JP 2001-242830 9/2001
WO WO 2005/033785 4/2005

OTHER PUBLICATIONS

Office Action issued in corresponding Chinese Application No. 2006101705132 mailed on Feb. 15, 2008.
Office Action issued in corresponding Japanese Patent Application No. 2006-330756; issued Apr. 30, 2010.

* cited by examiner

*Primary Examiner* — Kevin M Nguyen
*Assistant Examiner* — Joseph G Rodriguez
(74) *Attorney, Agent, or Firm* — Brinks Hofer Gilson & Lione

(57) ABSTRACT

An system is disclosed for driving a liquid crystal display for automatically adjusting a level of a common voltage at the point that a positive polarity gray scale level voltage and a negative polarity gray scale level voltage are supplied to a liquid crystal display panel.

A plurality of gate lines and a plurality of data lines are provided at a liquid crystal display panel. A gate driver supplies a gate pulse to the plurality of gate lines. A data driver supplies a positive polarity gray scale level voltage and a negative polarity gray scale level voltage to the plurality of data lines. A controller controls a common voltage level supplied to the liquid crystal display panel in accordance with a supply point of a gate pulse. A common voltage supplier alternatively supplies a first and second common voltage defined as a division reference of the positive polarity gray scale level voltage and the negative polarity gray scale level voltage based on a control of the controller to the liquid crystal display panel.

10 Claims, 8 Drawing Sheets

APPARATUS AND METHOD FOR DRIVING A LIQUID CRYSTAL DISPLAY

This application claims the benefit of priority of Korean Patent Application No. P05-0130781 filed in Korea on Dec. 27, 2005, the contents of which are hereby incorporated by reference.

BACKGROUND

1. Technical Field

The present invention relates to a liquid crystal display, and more particularly to system for driving a liquid crystal display that is capable of automatically adjusting a level of a common voltage at the point that a positive polarity gray scale level voltage and a negative polarity gray scale level voltage are supplied to a liquid crystal display panel.

2. Background

Generally, a liquid crystal display (LCD) controls light transmittance of liquid crystal cells based on video signals. An active matrix type of liquid crystal display having a switching device provided for each liquid crystal cell permits an active control of the switching device. The switching device used for the active matrix liquid crystal display mainly employs a thin film transistor (hereinafter, referred to as "TFT") as shown in FIG. 1.

Referring to FIG. 1, the active matrix LCD converts a digital input data into an analog data voltage based on a gamma reference voltage which supplies it to a data line DL and, at the same time, supplies a scanning pulse to a gate line GL to thereby charge a liquid crystal cell Clc.

A gate electrode of the TFT is connected to the gate line GL while a source electrode thereof is connected to the data line DL. Further, a drain electrode of the TFT is connected to a pixel electrode of the liquid crystal cell Clc and to one electrode of a storage capacitor Cst.

A common electrode of the liquid crystal cell Clc is supplied with a common voltage Vcom.

The storage capacitor Cst charges a data voltage fed from the data line DL when the TFT is turned-on, thereby constantly keeping a voltage at the liquid crystal cell Clc.

If the scanning pulse is applied to the gate line GL, then the TFT is turned on to provide a channel between the source electrode and the drain electrode thereof, thereby supplying a voltage on the data line DL to the pixel electrode of the liquid crystal cell Clc. In this case, liquid crystal molecules of the liquid crystal cell have an alignment changed by an electric field between the pixel electrode and the common electrode to thereby modulate an incident light.

A configuration of the related art LCD including pixels having the above-mentioned structure will be described with reference to FIG. 2.

FIG. 2 is a block diagram showing a configuration of a general liquid crystal display.

Referring to FIG. 2, a general liquid crystal display 100 includes a liquid crystal display panel 110 provided with a thin film transistor (TFT) for driving the liquid crystal cell Clc at an intersection of data lines DL1 to DLm and gate lines GL1 to GLn crossing each other, a data driver 120 for supplying a data to the data lines DL1 to DLm of the liquid crystal display panel 110, a gate driver 130 for supplying a scanning pulse to the gate lines GL1 to GLn of the liquid crystal display panel 110, a gamma reference voltage generator 140 for generating a gamma reference voltage to supply it to the data driver 120, a backlight assembly 150 for irradiating a light onto the liquid crystal display panel 110, an inverter 160 for applying an alternating current voltage and a current to the backlight assembly 150, a common voltage generator 170 for generating a common voltage Vcom to supply it to the common electrode of the liquid crystal cell Clc of the liquid crystal display panel 110, a gate driving voltage generator 180 for generating a gate high voltage VGH and a gate low voltage VGL to supply them to the gate driver 130, and a timing controller 190 for controlling the data driver 120 and the gate driver 130.

The liquid crystal display panel 110 has a liquid crystal injected between two glass substrates. On the lower glass substrate of the liquid crystal display panel 110, the data lines DL1 to DLm and the gate lines GL1 to GLn perpendicularly cross each other. Each intersection between the data lines DL1 to DLm and the gate lines GL1 to GLn is provided with the TFT. The TFT supplies data on the data lines DL1 to DLm to the liquid crystal cell Clc in response to the scanning pulse. The gate electrode of the TFT is connected to the gate lines GL1 to GLn while the source electrode thereof is connected to the data line DL1 to DLm. Further, the drain electrode of the TFT is connected to the pixel electrode of the liquid crystal cell Clc and to the storage capacitor Cst.

The TFT is turned-on in response to the scanning pulse applied, via the gate lines GL1 to GLn, to the gate terminal thereof. Upon turning-on of the TFT, a video data on the data lines DL1 to DLm is supplied to the pixel electrode of the liquid crystal cell Clc.

The data driver 120 supplies a data to the data lines DL1 to DLm in response to a data driving control signal DDC supplied from the timing controller 190. Further, the data driver 120 samples and latches a digital video data RGB fed from the timing controller 190, and then converts it into an analog data voltage capable of expressing a gray scale level at the liquid crystal cell Clc of the liquid crystal display panel 110 on the basis of a gamma reference voltage from the gamma reference voltage generator 140, thereby supplying it the data lines DL1 to DLm.

The gate driver 130 sequentially generates a scanning pulse, that is, a gate pulse in response to a gate driving control signal GDC and a gate shift clock GSC supplied from the timing controller 190 to supply them to the gate lines GL1 to GLn. The gate driver 130 determines a high level voltage and a low level voltage of the scanning pulse based on the gate high voltage VGH and the gate low voltage VGL supplied from the gate driving voltage generator 180.

The gamma reference voltage generator 140 receives a high-level supply voltage VDD to generate a positive gamma reference voltage and a negative gamma reference voltage and outputs them to the data driver 120.

The backlight assembly 150 is provided at the rear side of the liquid crystal display panel 110, and is radiated by an alternating current voltage and a current supplied from the inverter 160 to irradiate a light onto each pixel of the liquid crystal display panel 110.

The inverter 160 converts a square wave signal generated at the interior thereof into a triangular wave signal and then compares the triangular wave signal with a direct current power voltage VCC supplied from the system, thereby generating a burst dimming signal proportional to a result of the comparison. If the burst dimming signal is determined in accordance with the rectangular wave signal at the interior of the inverter 160, then a driving integrated circuit (IC) (not shown), for controlling a generation of the AC voltage and current within the inverter 160 controls a generation of AC voltage and current supplied to the backlight assembly 150 in response to the burst dimming signal.

The common voltage generator 170 receives a high-level power voltage VDD to generate a common voltage Vcom, and supplies it to the common electrode of the liquid crystal cell Clc provided at each pixel of the liquid crystal display panel 110.

The gate driving voltage generator 180 is supplied with a high-level power voltage VDD to generate the gate high voltage VGH and the gate low voltage VGL, and supplies them to the gate driver 130. Herein, the gate driving voltage generator 180 generates a gate high voltage VGH, more than a threshold voltage of the TFT provided at each pixel of the liquid crystal display panel 110, and a gate low voltage VGL less then the threshold voltage of the TFT. The gate high voltage VGH and the gate low voltage VGL generated in this manner are used for determining a high level voltage and a low level voltage of the scanning pulse generated by the gate driver 130, respectively.

The timing controller 190 supplies a digital video data RGB from a digital video card (not shown) to the data driver 120 and, at the same time, generates a data driving control signal DCC and a gate driving control signal GDC using horizontal/vertical synchronizing signals H and V in response to a clock signal CLK to supply them to the data driver 120 and the gate driver 130, respectively. Herein, the data driving control signal DDC includes a source shift clock SSC, a source start pulse SSP, a polarity control signal POL and a source output enable signal SOE, etc. The gate driving control signal GDC includes a gate start pulse GSP and a gate output enable signal GOE, etc.

An operation of the above-mentioned liquid crystal display will be described with reference to signal characteristics shown in FIG. 3.

First, if the gate driver 130 supplies a gate pulse A1 to the gate lines GL1 to GLn to drive a thin film transistor of each pixel, then the data driver 120 converts a digital data input from the timing controller 190 into an analog data A2 to supply it to a plurality of data lines DL1 to DLm. In this case, an analog data A2 is supplied in a square wave type which a positive polarity (+) section and a negative polarity (−) section bisected in such a manner to have a symmetry each other shown in FIG. 3, but substantially a positive polarity gray scale level voltage A3 and a negative polarity gray scale level voltage A4 are changed by an external environment and an interior resistance to not be supplied a square wave type and to generate a drop.

In a phenomenon in which a gray scale level voltage is dropped, a positive polarity gray scale level voltage and a negative polarity gray scale level voltage are all dropped, and a drop voltage ΔVp_P of a positive polarity gray scale level voltage and a drop voltage ΔVp_N of a negative polarity gray scale level voltage are the same as each other.

As described above, even though a positive polarity gray scale level voltage and a negative polarity gray scale level voltage are all dropped, a common voltage Vcom is always constantly supplied, so that a charging amount of a liquid crystal cell by a positive polarity gray scale level voltage is reduced as a magnitude of a drop voltage ΔVp_P while a charging amount of a liquid crystal cell by a negative polarity gray scale level voltage is increased as a magnitude of a drop voltage ΔVp_N. As a result, a charging amount of a positive polarity gray scale level voltage and a charging amount of a negative polarity gray scale level voltage are randomized, so that a flicker is generated on the screen.

SUMMARY

An apparatus and a method for driving a liquid crystal display are disclosed that are capable of automatically adjusting a level of a common voltage at the point that a positive polarity gray scale level voltage and a negative polarity gray scale level voltage supplied to a liquid crystal display panel.

An apparatus and a method for driving a liquid crystal display are also disclosed that automatically adjust a level of a common voltage at the point such that a positive polarity gray scale level voltage and a negative polarity gray scale level voltage supplied to a liquid crystal display panel to compensate a charging amount by a positive polarity gray scale level voltage and a negative polarity gray scale level voltage.

An apparatus and a method for driving a liquid crystal display compensate a charging amount by a positive polarity gray scale level voltage and a negative polarity gray scale level voltage to prevent a generation of a flicker on the screen.

A driving apparatus of a liquid crystal display comprises a liquid crystal display panel provided with a plurality of gate lines and a plurality of data lines; a gate driver that supplies a gate pulse to the plurality of gate lines; a data driver that supplies a positive polarity gray scale level voltage and a negative polarity gray scale level voltage to the plurality of data lines; a controller that controls a common voltage level supplied to the liquid crystal display panel in accordance with a supply point of a gate pulse; and a common voltage supplier that alternatively supplies a first and second common voltage defined as a division reference of the positive polarity gray scale level voltage and the negative polarity gray scale level voltage in accordance with a control of the controller to the liquid crystal display panel.

A method of driving a liquid crystal display comprises the steps of supplying a gate pulse to a plurality of gate lines provided at a liquid crystal display panel; supplying a positive polarity gray scale level voltage and a negative polarity gray scale level voltage to a plurality of data lines provided at the liquid crystal display panel; and alternatively supplying a first and second common voltage defined as a division reference of the positive polarity gray scale level voltage and the negative polarity gray scale level voltage in accordance with a supply point of a gate pulse to the liquid crystal display panel.

Other systems, methods, features and advantages of the invention will be, or will become, apparent to one with skill in the art upon examination of the following figures and detailed description. It is intended that all such additional systems, methods, features and advantages be included within this description, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like referenced numerals designate corresponding parts throughout the different views.

DETAILED DESCRIPTION

Figure 4:
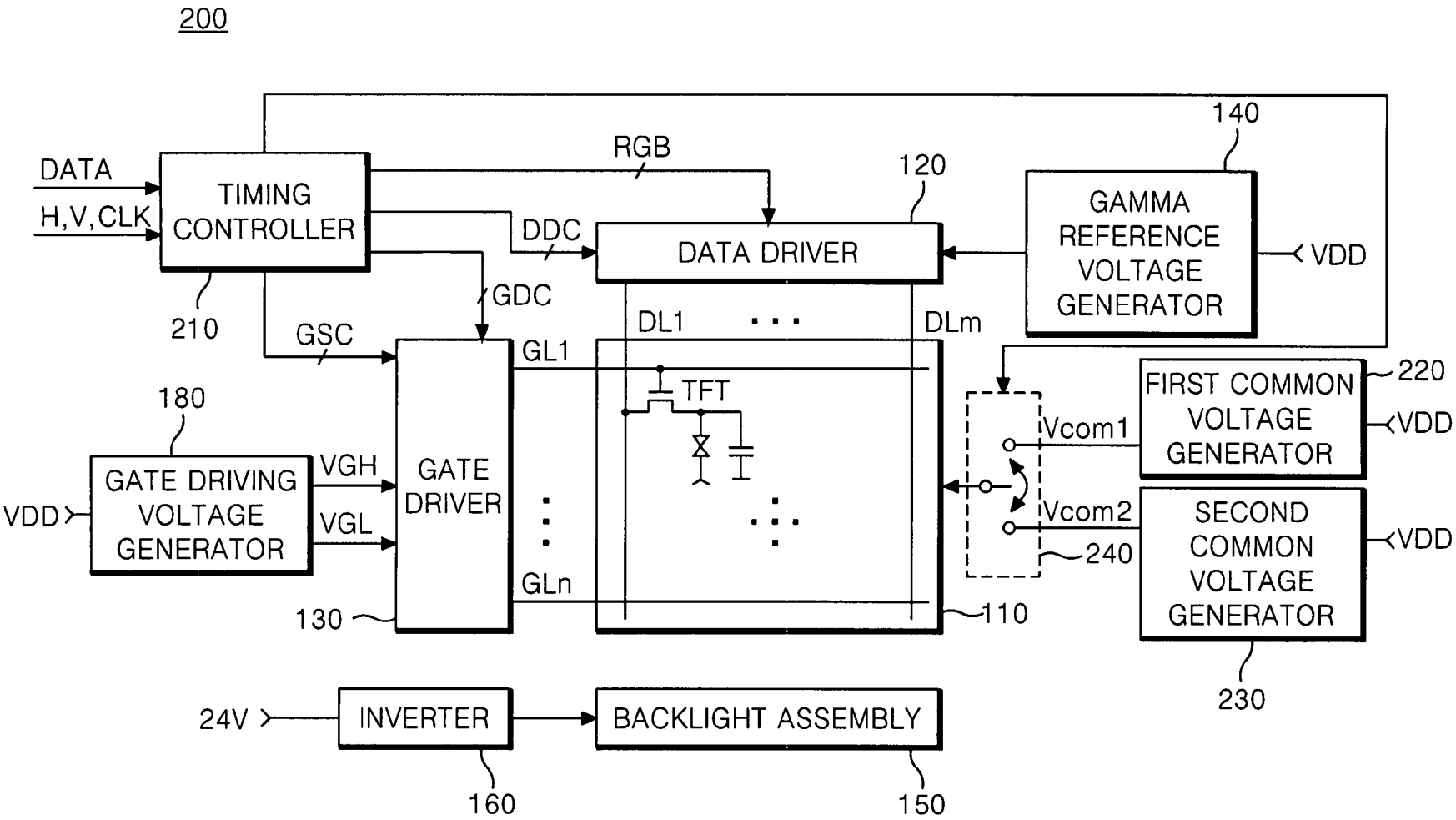
FIG. 4 is a block diagram showing a configuration of a driving apparatus of a liquid crystal display.

FIG. 4 is a block diagram showing a configuration of a driving apparatus of a liquid crystal display.

Figure 1:
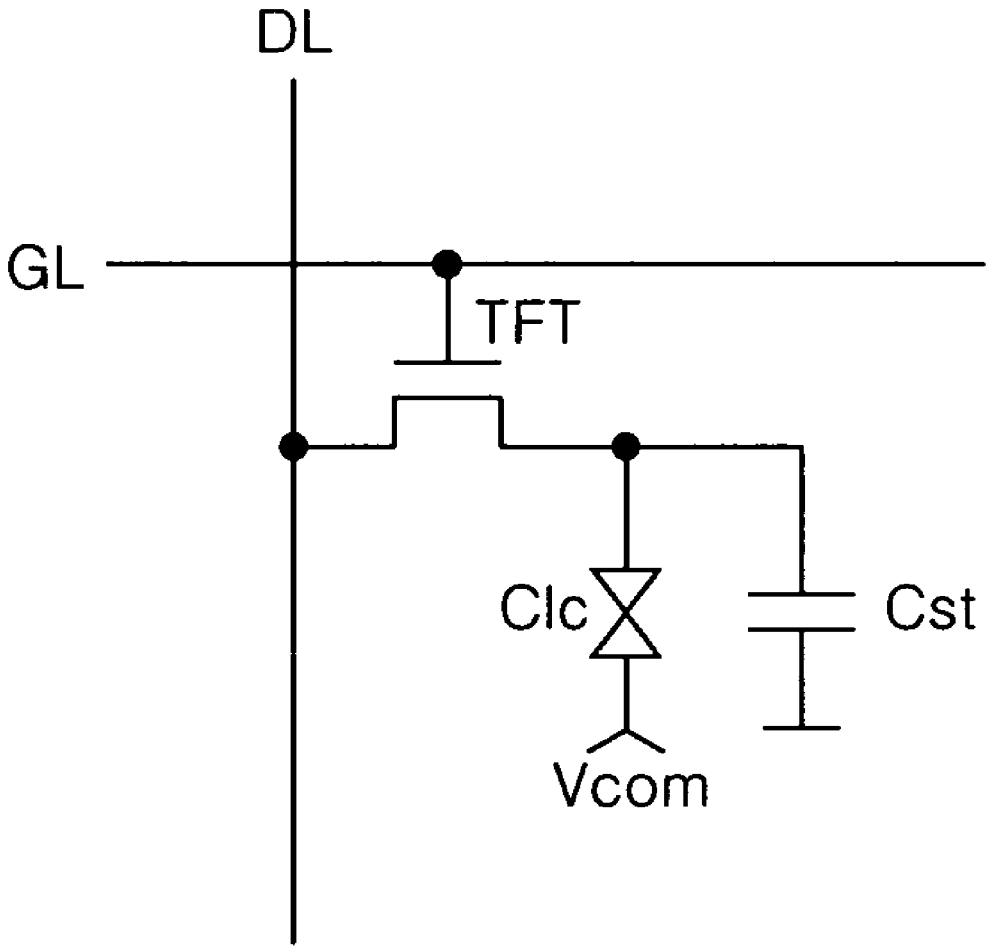
FIG. 1 is an equivalent circuit diagram of a pixel provided at a general liquid crystal display.
Figure 2:
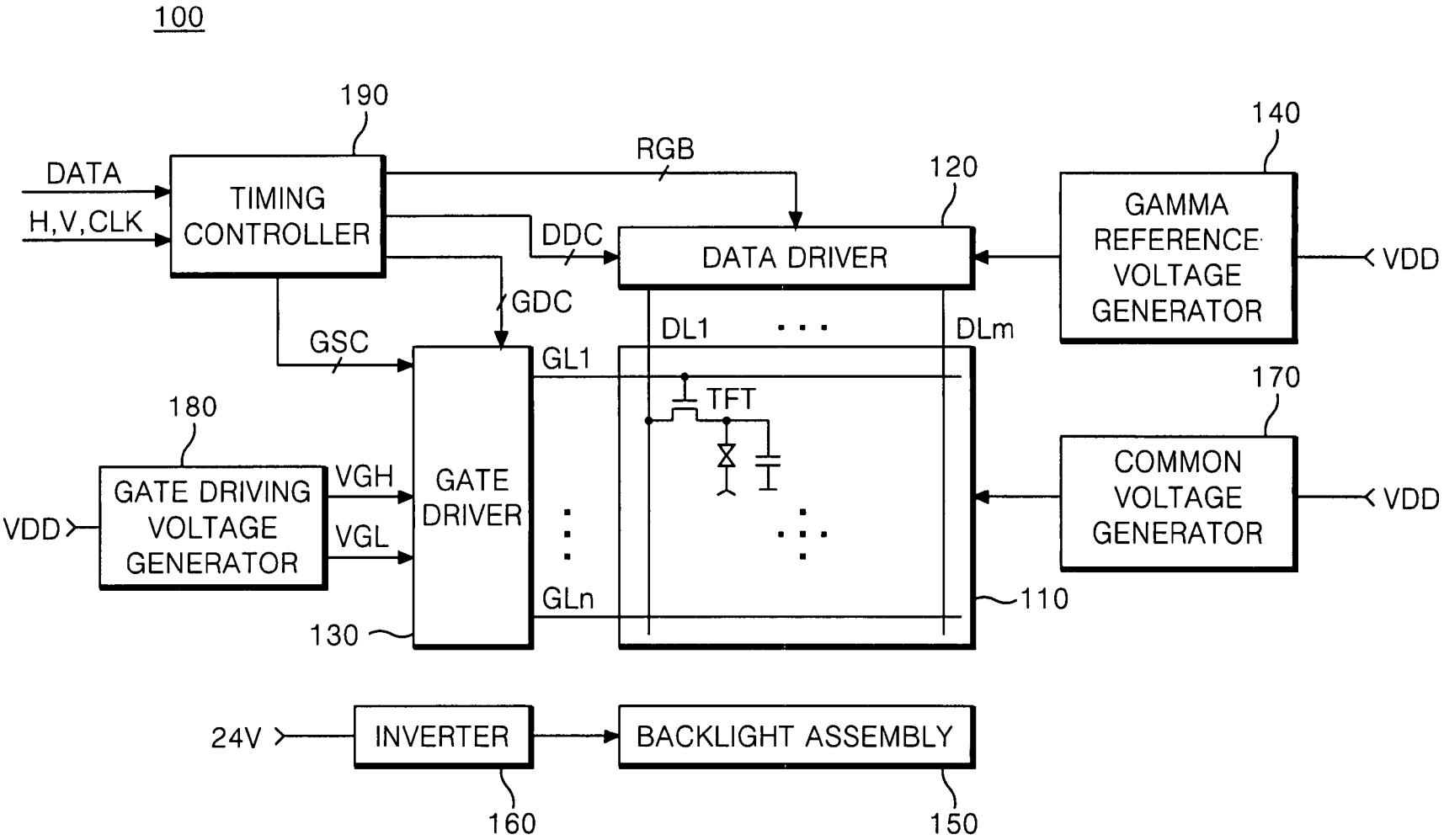
FIG. 2 is a block diagram showing a configuration of a related art liquid crystal display.

Referring to FIG. 4, a driving apparatus 200 of a liquid crystal display includes the liquid crystal display panel 110, the data driver 120, the gate driver 130, the gamma reference voltage generator 140, the backlight assembly 150, the inverter 160 and the gate driving voltage generator 180 likewise the liquid crystal display 100 as shown in FIG. 2, and includes a timing controller 210 that controls a level of a common voltage supplied to the liquid crystal display panel 110 based on a supply point of a gate pulse that is supplied to the gate lines GL1 to GLn, a first common voltage generator 220 that generates a first common voltage Vcom1, a second common voltage generator 230 that generates a second common voltage Vcom2, a switch 240 that selectively switches a first common voltage Vcom1 and a second common voltage Vcom2 in accordance with a control of the timing controller 210 to supply them the liquid crystal display panel 110.

The timing controller 210 controls a gate pulse supply of the gate driver 130 and times a supply point of a gate pulse supplied from the gate driver 130 to the gate lines GL1 to GLn. The timing controller 210 times a rising edge and a falling edge of a gate pulse, and accurately times a falling edge of a positive polarity section and a falling edge of a negative polarity section on the basis of a common voltage Vcom. Accordingly, the timing controller 210 controls in such a manner to be supplied the first common voltage Vcom1 to the liquid crystal display panel 110 during a constant time from a falling edge point of a gate pulse of a positive polarity section, and controls in such a manner to be supplied the second common voltage Vcom2 to the liquid crystal display panel 110 during a constant time from a falling edge point of a gate pulse of a negative polarity section.

The first common voltage generator 220 is applied with a high-level supply voltage VDD to generate a first common voltage Vcom1.

The second common voltage generator 230 is applied with a high-level supply voltage VDD to generate a second common voltage Vcom2.

A specific circuit configuration of such a first and second common voltage generator 220 and 230 will be described with reference to the accompanying drawings, that is, FIG. 5A to FIG. 5B.

If the switch 240 is switched forward in the first common voltage generator 220 direction by the timing controller 210, then the switch 240 allows a first common voltage Vcom1 to be supplied to the liquid crystal display panel 110 while if the switch 240 is switched forward in the second common voltage generator 230 direction by the timing controller 210, then the switch 240 allows a second common voltage Vcom2 to be supplied to the liquid crystal display panel 110.

Figure 5A:
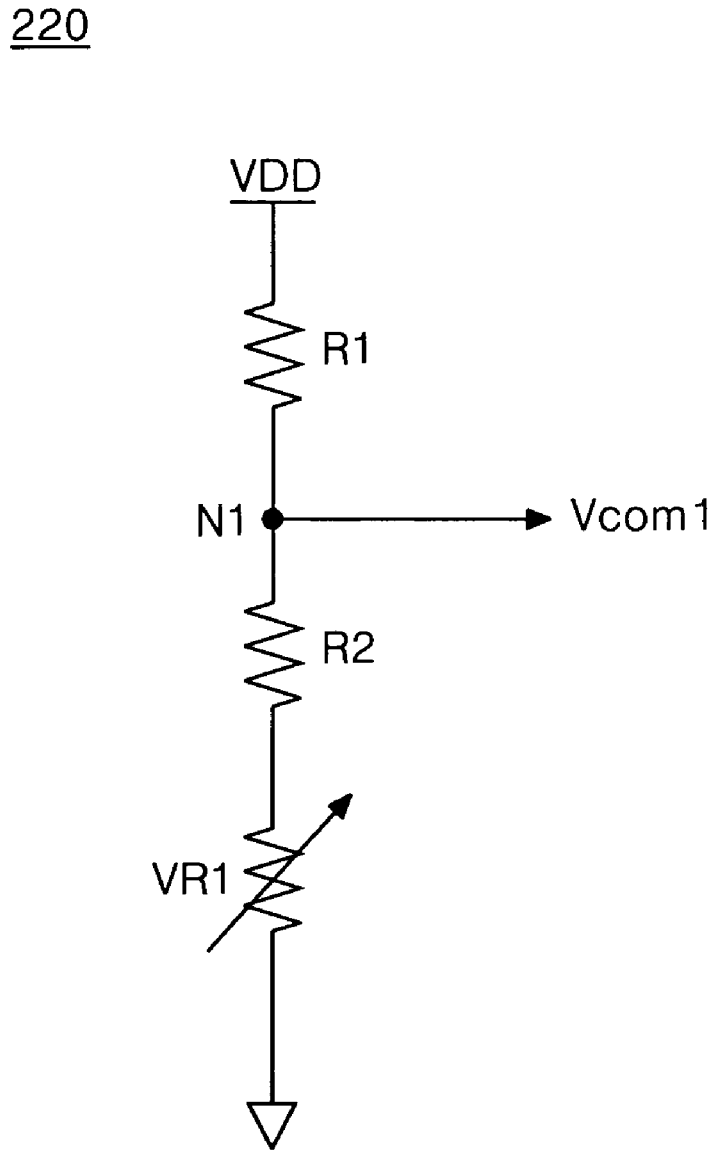
FIG. 5A is a circuit diagram of a first common voltage generator included in the driving apparatus of the liquid crystal display.
Figure 5B:
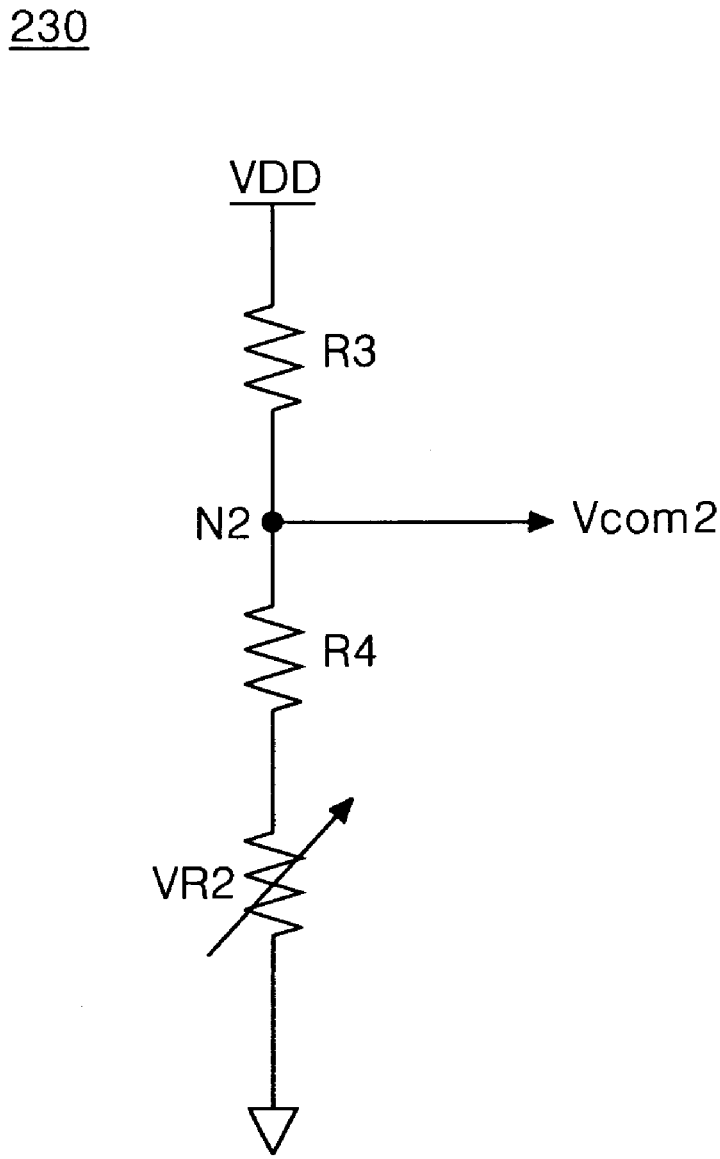
FIG. 5B is a circuit diagram of a second common voltage generator included in the driving apparatus of the liquid crystal display.

FIG. 5A and FIG. 5B are circuit diagrams of a first and second common voltage generator included in the driving apparatus of the liquid crystal display.

Referring to FIG. 5A, the first common voltage generator 220 comprises resistances R1 and R2 sequentially series-connected between a supply voltage VDD and a ground, and a variable resistance VR1. A first common voltage Vcom1 is generated at an output node N1 positioned between the resistances R1 and R2, and a magnitude thereof is determined by a resistance value of the resistances R1 and R2 and a resistance value of the variable resistance VR1.

Referring to FIG. 5B, the second common voltage generator 230 comprises resistances R3 and R4 sequentially series-connected between a supply voltage VDD and a ground, and a variable resistance VR2. A second common voltage Vcom2 is generated at an output node N2 positioned between the resistances R3 and R4, and a magnitude thereof is determined by a resistance value of the resistances R3 and R4 and a resistance value of the variable resistance VR2.

Figure 3:
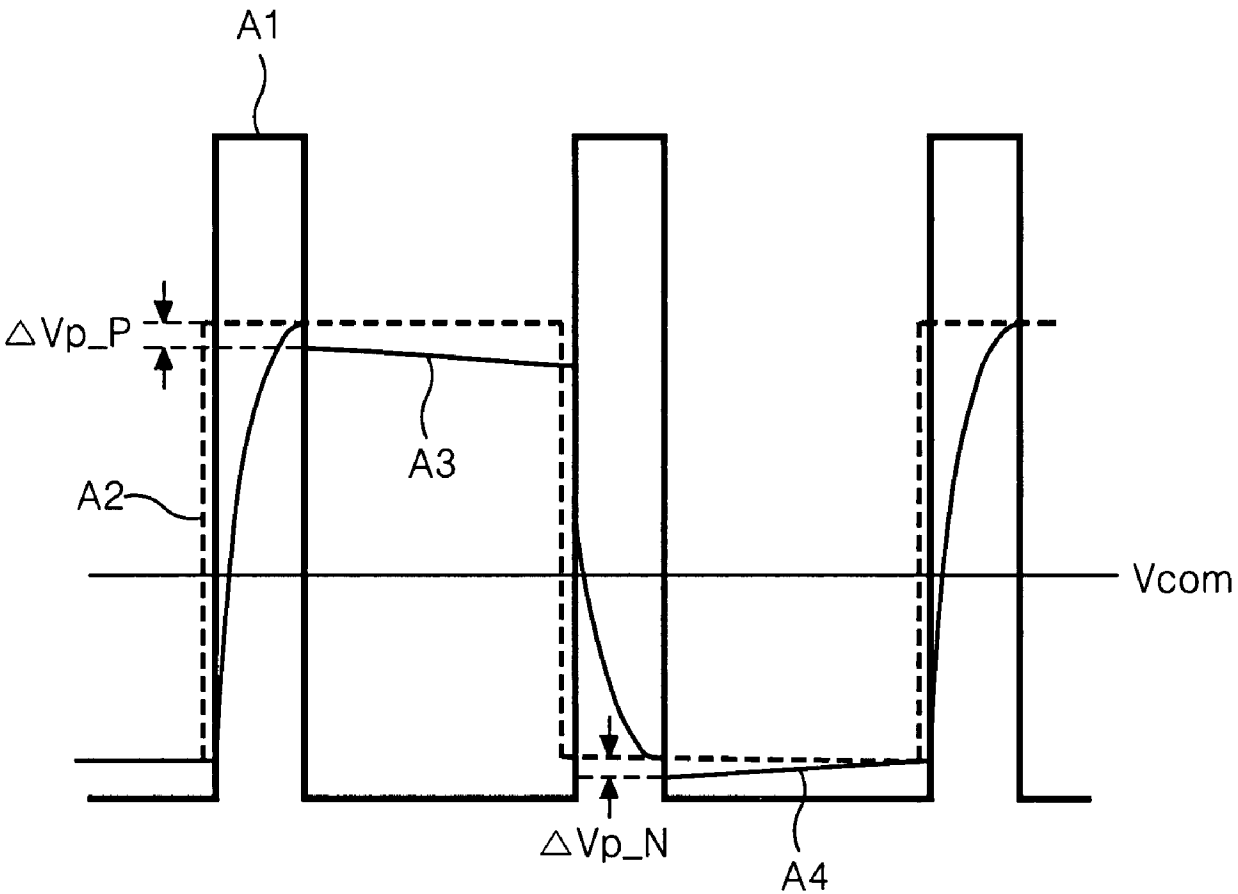
FIG. 3 is a signal characteristics diagram of a related art liquid crystal display.

A level of a first common voltage Vcom1 is generated from the first common voltage generator 220 in such a manner to have a higher level than that of a second common voltage Vcom2 generated from the second common voltage generator 230. Specially, if a second common voltage Vcom2 is subtracted from a first common voltage Vcom1, then a first common voltage Vcom1 and a second common voltage Vcom2 are set in such a manner to allow the subtracted common voltage level to be the same as the level of a drop voltage ΔVp_P of a positive polarity gray scale level voltage and a drop voltage ΔVp_N of a negative polarity gray scale level voltage in FIG. 3. Substantially, a level of a first common voltage Vcom1 is set in such a manner to be the same as the level of a common voltage Vcom in FIG. 3.

Accordingly, a positive polarity section and a negative polarity section of a gray scale level voltage is substantially divided on the basis of a first common voltage Vcom1, and a positive polarity section and a negative polarity section of a gray scale level voltage is divided by a second common voltage Vcom2 at a section which a second common voltage Vcom2 is supplied to the liquid crystal display panel 110 during a constant time.

Figure 6:
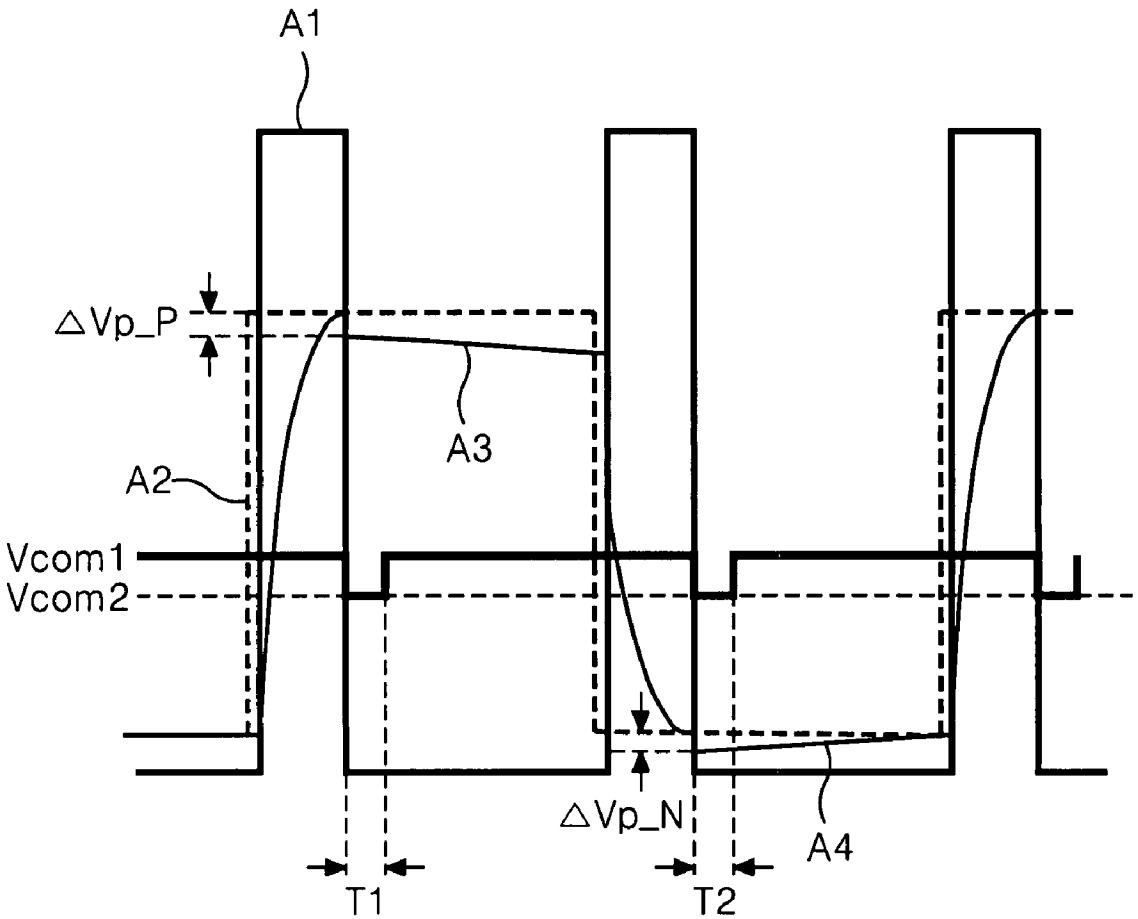
FIG. 6 is a characteristics diagram of a signal supplied from the driving apparatus of the liquid crystal display.

FIG. 6 is a characteristics diagram of a signal supplied from the driving apparatus of the liquid crystal display. Referring to FIG. 6, A1 represents a gate pulse supplied to the gate lines GL1 to GLn. A2 provides a type of an analog data supplied to a plurality of data lines DL1 to DLm. A3 provides a positive polarity gray scale level voltage substantially supplied to each pixel and A4 provides a negative polarity gray scale level voltage substantially supplied to each pixel.

A process which the driving apparatus of the liquid crystal display that supplies a signal having a characteristic shown in FIG. 6 automatically controls a common voltage level will be described with reference to a flow chart shown in FIG. 7.

Figure 7:
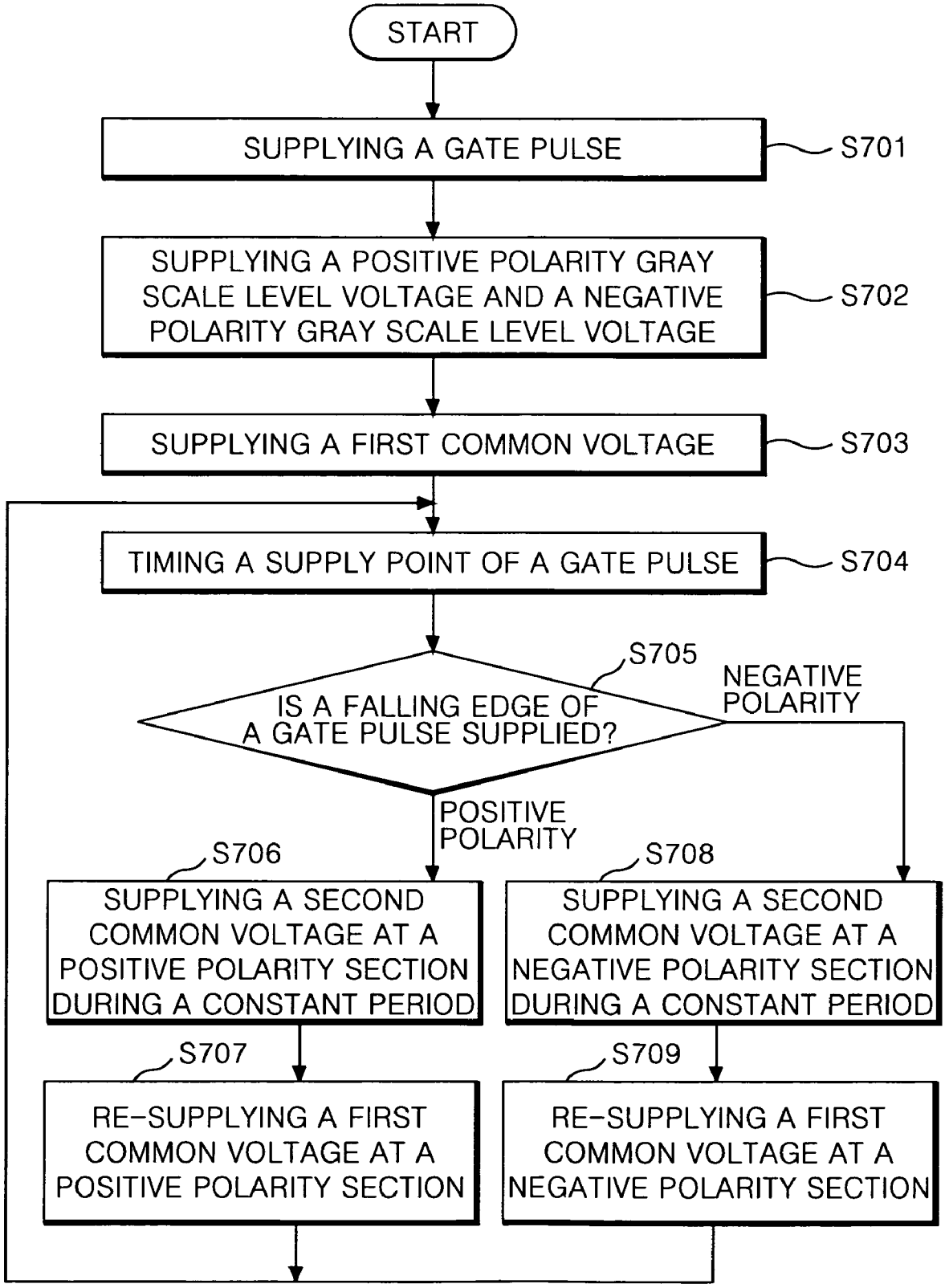
FIG. 7 is a flow chart regarding a driving method of the liquid crystal display.

Referring to FIG. 7, the gate driver 130 supplies a gate pulse A1 based on a gate driving control signal supplied from the timing controller 210 to the gate lines GL1 to GLn (S701). The data driver 120 converts a digital data input from the timing controller 210 into an analog data A2 to supply it to the data lines DL1 to DLm, but substantially a positive polarity gray scale level voltage A3 and a negative polarity gray scale level voltage A4 are supplied to a thin film transistor of each pixel provided at the liquid crystal display panel 110 (S702).

The switch 240 is switched forward in the first common voltage generator 220 direction by the timing controller 210. Then the switch 240 allows a first common voltage Vcom1 to be supplied to each pixel of the liquid crystal display panel 110 (S703). The timing controller 210 times a supply point of a gate pulse supplied from the gate driver 130 to the gate lines GL1 to GLn (S704) to judge whether a falling edge of a gate pulse is supplied at the positive polarity section and a negative polarity section (S705) on a state that a first common voltage Vcom1 is supplied. In this process, the timing controller 210 accurately times and judges a falling edge of a positive polarity section and a falling edge of a negative polarity section on the basis of a first common voltage Vcom1.

As a result, if a falling edge of a gate pulse is supplied at the positive polarity section, that is, a positive polarity gray scale level voltage A3 is dropped as a drop voltage ΔVp_P, then the timing controller 210 switches the switch 240 forward in the second common voltage generator 230 direction in such a manner to be supplied a second common voltage Vcom2 to the liquid crystal display panel 110 during a constant time T1 from a falling edge point of a gate pulse of the positive polarity section (S706). In this case, the timing controller 210 times a supply time of a second common voltage Vcom2. Next, if a constant time T1 is passed, then the timing controller 210 again switches the switch 240 forward in the first common voltage generator 220 direction in such a manner to be supplied a first common voltage Vcom1 to the liquid crystal display panel 110 (S707).

A second common voltage Vcom2 is supplied having a lower level than a first common voltage Vcom1 during a constant time T1 from a drop point of a positive polarity gray scale level voltage A3 to reduce a level of a common voltage as a level of a drop voltage ΔVp_P, so that it becomes possible to compensate a charging amount of a liquid crystal cell reduced by a drop voltage ΔVp_P.

If a falling edge of a gate pulse is supplied at the negative polarity section, that is, a negative polarity gray scale level voltage A4 is dropped as a drop voltage ΔVp_N, then the timing controller 210 switches the switch 240 forward the second common voltage generator 230 direction in such a manner to be supplied a second common voltage Vcom2 to the liquid crystal display panel 110 during a constant time T2 from a falling edge point of a gate pulse of the negative polarity section (S708). In this case, the timing controller 210 times a supply time of a second common voltage Vcom2. Next, if a constant time T2 is passed, then the timing controller 210 again switches the switch 240 forward in the first common voltage generator 220 direction in such a manner to be supplied a first common voltage Vcom1 to the liquid crystal display panel 110 (S709). Herein, a supply time T2 of a second common voltage Vcom2 of the negative polarity section is the same as the supply time T1 of a second common voltage Vcom2 of the positive polarity section.

A second common voltage Vcom2 is supplied having a lower level than a first common voltage Vcom1 during a constant time T1 from a drop point of a negative polarity gray scale level voltage A4 to reduce a level of a common voltage as a level of a drop voltage ΔVp_N, so that it becomes possible to reduce a charging amount of a liquid crystal cell reduced by a drop voltage ΔVp_P. Thus, it allows a charging amount by a positive polarity gray scale level voltage and a charging amount by a negative polarity gray scale level voltage to be the same each other. As a result, a charging amount is allowed by the positive polarity section and a charging amount by the negative polarity section to be the same, so that it becomes possible to prevent a generation of a flicker on the screen.

As described above, the present disclosure reduces a level of a common voltage during a constant time from a point which a positive polarity gray scale level voltage supplied to the liquid crystal display panel is dropped, and reduces a level of a common voltage during a constant time from a point which a negative polarity gray scale level voltage supplied to the liquid crystal display panel is dropped, so that it becomes possible to compensate a charging amount by a positive polarity gray scale level voltage and a negative polarity gray scale level voltage. Thus, it can prevent a generation of a flicker on the screen.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. A driving apparatus of a liquid crystal display, comprising:

a liquid crystal display panel provided with a plurality of gate lines and a plurality of data lines;

a gate driver that supplies a gate pulse to the plurality of gate lines;

a data driver that supplies a positive polarity gray scale level voltage and a negative polarity gray scale level voltage to the plurality of data lines;

a controller that controls a common voltage level supplied to the liquid crystal display panel based on a supply point of a gate pulse; and a common voltage supplier that alternatively supplies a first common voltage and a second common voltage defined as a division reference of the positive polarity gray scale level voltage and the negative polarity gray scale level voltage based on a control signal of the controller to the liquid crystal display panel, wherein a level of the first common voltage is set to have a higher level than a level of the second common voltage, wherein the controller controls the common voltage supplier to alternatively supply the first common voltage and the second common voltage on a state that the positive gray scale level voltage is supplied, and controls the common voltage supplier to supply the second common voltage level to the liquid crystal display panel during a constant time from a falling edge point of a gate pulse, wherein the falling edge point is when the gate pulse falls from the high level to the low level, and wherein the constant time is less the period than a period of the positive gray scale level voltage or the negative gray scale level voltage, wherein the width of the second common voltage is less than that of the gate pulse, and wherein the level of the first common voltage is supplied to the liquid crystal display panel during the section of the gate pulse.

2. The driving apparatus of the liquid crystal display of claim 1, wherein the controller controls the common voltage supplier to alternatively supply the first common voltage and the second common voltage on a state that the negative gray scale level voltage is supplied, and controls the common voltage supplier to supply the second common voltage level to the liquid crystal display panel during a constant time from a falling edge point of a gate pulse.

3. The driving apparatus of the liquid crystal display of claim 1, wherein the common voltage supplier includes:

a first common voltage generator operable to receive a high-level supply voltage to generate the first common voltage;

a second common voltage generator operable to receive a high-level supply voltage to generate the second common voltage; and a switch operable to be controlled in a switching direction by the controller to supply the first common voltage and the second common voltage to switch into the liquid crystal display panel.

4. A method of driving a liquid crystal display, comprising:

supplying a gate pulse to a plurality of gate lines provided at a liquid crystal display panel;

supplying a positive polarity gray scale level voltage and a negative polarity gray scale level voltage to a plurality of data lines provided at the liquid crystal display panel;

alternatively supplying a first common voltage and a second common voltage defined as a division reference of the positive polarity gray scale level voltage and the negative polarity gray scale level voltage based on a supply point of a gate pulse to the liquid crystal display panel; and setting a level of the first common voltage to have a higher level than a level of the second common voltage; and timing a supply point of a rising edge and a falling edge of a gate pulse on a state such that the positive gray scale level voltage is supplied, wherein if a supply point of a falling edge of a gate pulse is timed on a state that the positive gray scale level voltage is supplied, then a supply of the first common voltage is temporarily stopped and the second common voltage is supplied to the liquid crystal display panel during a constant time from a falling edge point of a gate pulse, wherein the falling edge point is when the gate pulse falls from the high level to the low level, and wherein the constant time is less the period than a period of the positive gray scale level voltage or the negative gray scale level voltage, wherein the width of the second common voltage is less than that of the gate pulse, and wherein the level of the first common voltage is supplied to the liquid crystal display panel during the section of the gate pulse.

5. The method of driving the liquid crystal display of claim 4, wherein if a supply time of the second common voltage on a state that the positive gray scale level voltage is passed, then the first common voltage which a supply is temporarily stopped is again supplied to the liquid crystal display panel.

6. A method of driving a liquid crystal display, comprising:

supplying a gate pulse to a plurality of gate lines provided at a liquid crystal display panel;

supplying a positive polarity gray scale level voltage and a negative polarity gray scale level voltage to a plurality of data lines provided at the liquid crystal display panel;

alternatively supplying a first common voltage and a second common voltage defined as a division reference of the positive polarity gray scale level voltage and the negative polarity gray scale level voltage based on a supply point of a gate pulse to the liquid crystal display panel;

setting a level of the first common voltage to have a higher level than a level of the second common voltage; and timing a supply point of a rising edge and a falling edge of a gate pulse on a state that the negative gray scale level voltage is supplied, wherein if a supply point of a falling edge of a gate pulse is timed on a state that the negative gray scale level voltage is supplied, then a supply of the first common voltage is temporarily stopped and the second common voltage is supplied to the liquid crystal display panel during a constant time from a falling edge point of a gate pulse, wherein the falling edge point is when the gate pulse falls from the high level to the low level, wherein the constant time is less the period than a period of the positive gray scale level voltage or the negative gray scale level voltage, wherein the width of the second common voltage is less than that of the gate pulse, and wherein the level of the first common voltage is supplied to the liquid crystal display panel during the section of the gate pulse.

7. The method of driving the liquid crystal display of claim 6, wherein if a supply time of the second common voltage on a state that the negative gray scale level voltage is passed, then the first common voltage which a supply is temporarily stopped is again supplied to the liquid crystal display panel.

8. A driving apparatus comprising:

a gate driver that supplies a gate pulse;

a data driver that supplies a positive polarity gray scale level voltage and a negative polarity gray scale level voltage;

a controller that controls a common voltage level based on a supply point of a gate pulse; and a common voltage supplier that alternatively supplies a first common voltage and a second common voltage defined as a division reference of the positive polarity gray scale level voltage and the negative polarity gray scale level voltage based on a control signal of the controller, wherein a level of the first common voltage is set to have a higher level than a level of the second common voltage, wherein the controller controls the common voltage supplier to alternatively supply the first common voltage and the second common voltage on a state that the positive gray scale level voltage is supplied, and controls the common voltage supplier to supply the second common voltage level during a constant time from a falling edge point of a gate pulse, wherein the falling edge point is when the gate pulse falls from the high level to the low level, and wherein the constant time is less the period than a period of the positive gray scale level voltage or the negative gray scale level voltage, wherein the width of the second common voltage is less than that of the gate pulse, and wherein the level of the first common voltage is supplied to the liquid crystal display panel during the section of the gate pulse.

9. The driving apparatus of claim 8, wherein the controller controls the common voltage supplier to alternatively supply the first common voltage and the second common voltage on a state that the negative gray scale level voltage is supplied, and controls the common voltage supplier to supply the second common voltage level during a constant time from a falling edge point of a gate pulse.

10. The driving apparatus of claim 8, wherein the common voltage supplier includes:

a first common voltage generator operable to receive a high-level supply voltage to generate the first common voltage;

a second common voltage generator operable to receive a high-level supply voltage to generate the second common voltage; and a switch operable to be controlled in a switching direction by the controller to supply the first common voltage and the second common voltage.

* * * * *